US008981649B2

(12) United States Patent
Lee et al.

(10) Patent No.: US 8,981,649 B2
(45) Date of Patent: Mar. 17, 2015

(54) LIGHT EMITTING DIODE DRIVING APPARATUS

(71) Applicant: Samsung Electro-Mechanics Co., Ltd., Suwon, Gyunggi-do (KR)

(72) Inventors: Yun Joong Lee, Gyunggi-do (KR); Jong Tae Hwang, Gyunggi-do (KR); Chan Woo Park, Gyunggi-do (KR); Je Hyeon Yu, Gyunggi-do (KR); Chang Seok Lee, Gyunggi-do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 179 days.

(21) Appl. No.: 13/842,244

(22) Filed: Mar. 15, 2013

(65) Prior Publication Data

US 2014/0184077 A1 Jul. 3, 2014

(30) Foreign Application Priority Data

Dec. 28, 2012 (KR) ..... 10-2012-0157056

(51) Int. Cl.
*H05B 33/08* (2006.01)

(52) U.S. Cl.
CPC ..... *H05B 33/083* (2013.01)
USPC ..... 315/122; 315/291

(58) Field of Classification Search
None
See application file for complete search history.

(56) References Cited

U.S. PATENT DOCUMENTS 4,575,668 A * 3/1986 Baker ..... 318/811
7,081,722 B1 * 7/2006 Huynh et al. ..... 315/323
7,439,944 B2 * 10/2008 Huynh et al. ..... 345/82
7,592,755 B2 * 9/2009 Chen et al. ..... 315/291
7,659,496 B2 * 2/2010 Lin ..... 250/205
7,710,047 B2 * 5/2010 Shteynberg et al. ..... 315/291
7,741,788 B2 * 6/2010 Ito et al. ..... 315/247
7,902,771 B2 * 3/2011 Shteynberg et al. ..... 315/307
7,986,107 B2 * 7/2011 Weaver et al. ..... 315/291
8,054,283 B2 * 11/2011 Lee et al. ..... 345/102
8,164,276 B2 * 4/2012 Kuwabara ..... 315/294
8,324,840 B2 * 12/2012 Shteynberg et al. ..... 315/308
8,410,717 B2 * 4/2013 Shteynberg et al. ..... 315/291
8,569,956 B2 * 10/2013 Shteynberg et al. ..... 315/123
8,665,922 B2 * 3/2014 Fujimura et al. ..... 372/38.07

(Continued)

FOREIGN PATENT DOCUMENTS

JP 2005-151674 A 6/2005
KR 10-2002-0089885 A 11/2002

(Continued)

OTHER PUBLICATIONS

Korean Office Action issued in Korean Application No. 10-2012-0157056 dated Mar. 28, 2014, with English Translation.

*Primary Examiner* — Crystal L Hammond
(74) *Attorney, Agent, or Firm* — McDermott Will & Emery LLP

(57) ABSTRACT

There is provided a light emitting diode (LED) driving apparatus configured such that a waveform of current input to an LED follows a sine wave, the LED driving apparatus including, a switching unit switching an LED unit having a plurality of LEDs receiving rectified power and emitting light, a driving control unit controlling the switching of the switching unit according to a voltage level of the rectified power, a current limiting unit limiting current flowing in the LED unit, and an adjusting unit adjusting current limitation of the current limiting unit according to the voltage level of the rectified power.

16 Claims, 5 Drawing Sheets

(56) References Cited

U.S. PATENT DOCUMENTS

| | | | | |
|---|---|---|---|---|
| 8,686,651 | B2 * | 4/2014 | Lynch et al. | 315/192 |
| 8,760,058 | B2 * | 6/2014 | Song et al. | 315/113 |
| 2008/0157699 | A1 * | 7/2008 | Lee et al. | 315/294 |
| 2008/0203946 | A1 * | 8/2008 | Ito et al. | 315/307 |
| 2010/0308738 | A1 * | 12/2010 | Shteynberg et al. | 315/185 R |
| 2010/0308739 | A1 * | 12/2010 | Shteynberg et al. | 315/193 |
| 2010/0308743 | A1 * | 12/2010 | Liang et al. | 315/253 |
| 2011/0273103 | A1 | 11/2011 | Hong | |
| 2012/0081009 | A1 * | 4/2012 | Shteynberg et al. | 315/122 |
| 2012/0256546 | A1 * | 10/2012 | Yang | 315/144 |
| 2012/0256547 | A1 * | 10/2012 | Yang | 315/144 |
| 2012/0299483 | A1 * | 11/2012 | Lethellier | 315/121 |
| 2013/0026949 | A1 * | 1/2013 | Yamamoto et al. | 315/297 |
| 2013/0200796 | A1 * | 8/2013 | Song et al. | 315/113 |
| 2014/0239847 | A1 * | 8/2014 | Kim et al. | 315/297 |

FOREIGN PATENT DOCUMENTS

| | | | |
|---|---|---|---|
| KR | 10-0997050 | B1 | 11/2010 |
| KR | 100995793 | B1 | 11/2010 |
| KR | 1020110037133 | A | 4/2011 |
| KR | 1020110126869 | A | 11/2011 |
| KR | 10-2012-0026949 | A | 3/2012 |
| KR | 10-2012-0069512 | A | 6/2012 |

* cited by examiner

LIGHT EMITTING DIODE DRIVING APPARATUS

CROSS-REFERENCE TO RELATED APPLICATIONS

This application claims the priority of Korean Patent Application No. 10-2012-0157056 filed on Dec. 28, 2012, in the Korean Intellectual Property Office, the disclosure of which is incorporated herein by reference.

BACKGROUND OF THE INVENTION

1. Field of the Invention

The present invention relates to a light emitting diode (LED) driving apparatus for directly driving an LED using alternating current (AC) power.

2. Description of the Related Art

A light emitting diode (LED) is a semiconductor element having a p-n junction structure and emitting light through electron-hole recombination, and has recently been used in various fields, according to the development of semiconductor technology.

Particularly, since an LED has high efficiency, a relatively long lifespan, and environmentally friendly characteristics, as compared to a light emitting device according to the related art, a range of applications thereof is continuously being widened.

Generally, an LED may be driven by applying several volts of direct current (DC) voltage thereto, due to a structure thereof. Therefore, in order to drive the LED using commercial alternating current (AC) power, commonly used domestically, commercially, or the like, a separate unit is required.

In order to drive the LED using commercial AC power, an LED driving apparatus typically includes a rectifying circuit, an alternating current-direct current converter (an AC-DC converter), and the like.

However, a general AC-DC converter has large volume and consumes a significant amount of power. Therefore, in a case in which a general AC-DC converter is applied to the LED driving apparatus, advantages of the LED such as high efficiency, a small packaging size, a long lifespan, and the like are largely canceled.

Therefore, research into an apparatus capable of directly driving an LED with AC power without using an AC-DC converter has been recently conducted.

In the case of directly driving the LED with AC power without using the AC-DC converter, a method in which a plurality of switches are respectively connected to a plurality of LEDs and switching on and switching off of the plurality of switches are controlled according to a level of the AC power to allow current to uniformly flow may be generally applied.

Patent Document 1 relates to an LED driving apparatus, in which an LED is directly driven to emit light using AC power by controlling operations of switches connected to a medium node and the last node of an LED array.

Patent Document 2 also relates to an LED driving apparatus, and discloses a configuration controlling switching on and switching off of a switch in an order in which LED arrays are connected.

However, while both Patent Documents 1 and 2 control the operation of the switch according to a level of the AC power, a waveform of input current due to switch driving is formed as a step-type waveform, thereby deteriorating a power factor and total harmonic distortion characteristics.

RELATED ART DOCUMENT (Patent Document 1) Korean Patent No. 10-0997050-0000
(Patent Document 2) Korean Patent No. 10-0995793-0000

SUMMARY OF THE INVENTION

An aspect of the present invention provides a light emitting diode (LED) driving apparatus configured such that a waveform of current input to an LED follows a sine wave.

According to an aspect of the present invention, there is provided a light emitting diode (LED) driving apparatus, including: a switching unit switching an LED unit having a plurality of LEDs receiving rectified power and emitting light; a driving control unit controlling switching driving of the switching unit according to a voltage level of the rectified power; a current limiting unit limiting current flowing in the LED unit; and an adjusting unit adjusting current limitation of the current limiting unit according to the voltage level of the rectified power.

The adjusting unit may adjust the current of the current limiting unit according to a voltage waveform of the rectified power.

The adjusting unit may include: a voltage dividing unit dividing the voltage level of the rectified power; and an automatic gain adjusting unit adjusting a current amount of the current limiting unit according to the divided voltage level of the voltage dividing unit.

The automatic gain adjusting unit may include: a comparator comparing the divided voltage level of the voltage dividing unit with a level of a preset operational reference voltage; a dividing resistor group dividing the divided voltage level of the voltage dividing unit according to a preset resistance ratio; a limiting unit limiting the voltage level divided by the dividing resistor group to a preset level; a converting unit converting a peak value of the limited voltage level from the limiting unit into a digital signal; and a peak controlling unit controlling the peak value of the voltage level from the converting unit to maintain a constant peak voltage regardless of the divided voltage level of the voltage dividing unit.

The switching unit may include a plurality of switches, respectively connected between connection points between the plurality of respective LEDs of the LED unit and the current limiting unit.

The driving control unit may include: a comparing unit comparing the rectified power with a preset reference voltage; and a driving unit providing a switching driving signal controlling switching driving of the LED unit according to a comparison result of the comparing unit.

The comparing unit may include a plurality of comparators having a number corresponding to that of the LEDs of the LED unit.

The current limiting unit may include: a current control unit having a plurality of switches controlling current flowing in the switching unit according to a driving control of the driving control unit; and a current source unit having a plurality of current sources adjusting a current amount according to a current adjustment of the adjusting unit.

The LED driving apparatus may further include a rectifying unit rectifying alternating current (AC) power to supply the rectified power to at least one pair of the LEDs.

According to another aspect of the present invention, there is provided a light emitting diode (LED) driving apparatus, including: a rectifying unit rectifying and supplying alternating current power; a switching unit switching an LED unit having a plurality of LEDs receiving rectified power and emitting light; a driving control unit controlling switching driving of the switching unit according to a voltage level of the rectified power; a current limiting unit limiting current flowing in the LED unit; and an adjusting unit adjusting current limitation of the current limiting unit according to a voltage waveform of the rectified power.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
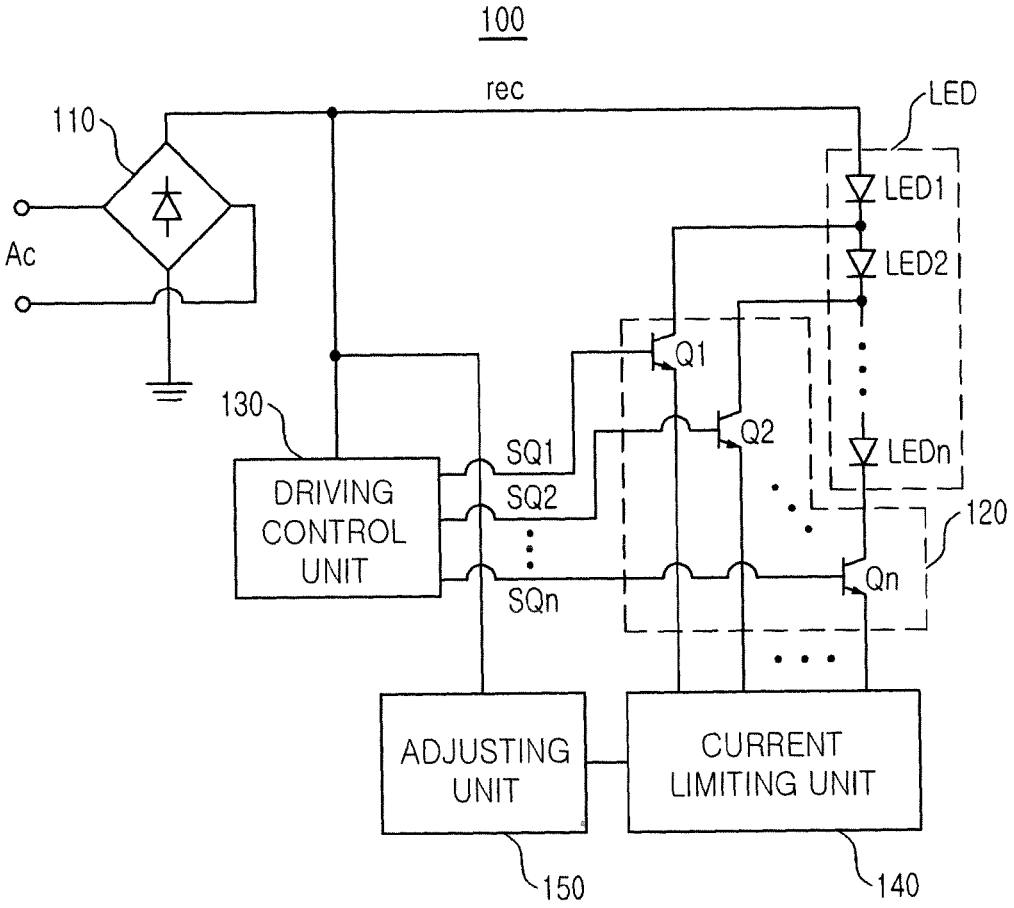
FIG. 1 is a view schematically showing a configuration of a light emitting diode (LED) driving apparatus according to an embodiment of the present invention.

Hereinafter, embodiments of the present invention will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like elements.

FIG. 1 is a view schematically showing a configuration of a light emitting diode (LED) driving apparatus according to an embodiment of the present invention.

Referring to FIG. 1, an LED driving apparatus 100 according to the embodiment of the present invention may include a rectifying unit 110, a switching unit 120, a driving control unit 130, a current limiting unit 140, and an adjusting unit 150.

The rectifying unit 110 may receive alternating current (AC) power to half-wave rectify or full-wave rectify the AC power through a bridge diode, and may supply rectified power rec to LEDs to enable the LEDs to perform a light emitting operation.

An LED unit may include a plurality of LEDs LED1 through LEDn connected to one another in series.

The switching unit 120 includes a plurality of switches Q1 through Qn respectively correspond to the plurality of LEDs LED1 through LEDn of the LED unit.

Each of the plurality of switches Q1 through Qn is connected between a connection point between the LEDs adjacent to each other and the current limiting unit 140 as shown in FIG. 1 and is switched on or switched off according to a switching driving signal, such that each switch may form a current path for each LED corresponding thereto to control the driving of the corresponding LED.

For example, when the first switch Q1 is switched on, the first diode LED1 may be driven, and when the second switch Q2 is switched on, the first and second diodes LED1 and LED2 may be driven. Similarly, when the n-th switch Qn is switched on, the first through N-th diodes LED1 through LEDn may be driven.

The driving control unit 130 may compare the rectified power rec from the rectifying unit 110 with a preset reference voltage to control the driving of the corresponding switch.

Figure 2:
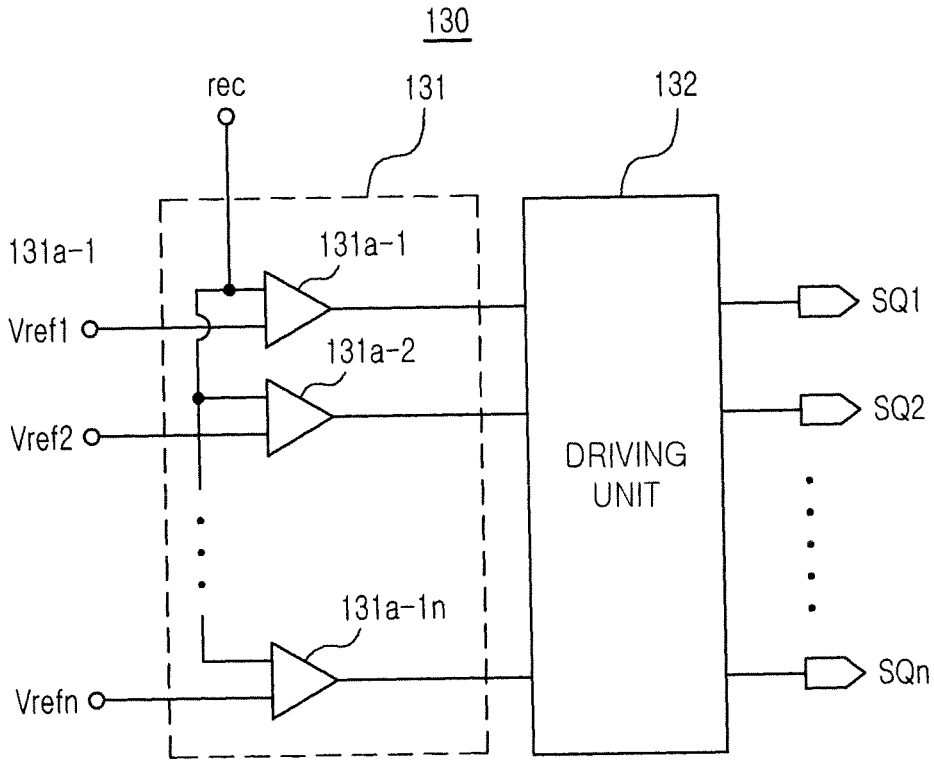
FIG. 2 is a view schematically showing a configuration of a driving control unit used in the LED driving apparatus according to the embodiment of the present invention.

FIG. 2 is a view schematically showing a configuration of a driving control unit used in the LED driving apparatus according to the embodiment of the present invention.

Referring to FIGS. 1 and 2, the driving control unit 130 may include a comparing unit 131 and a driving unit 132.

The comparing unit 131 may include a plurality of comparators 131*a*-1 through 131*a*-*n*, and the plurality of respective comparators 131*a*-1 through 131*a*-*n* may compare preset plurality reference voltages Vref1 through VrefN with the rectified power rec from the rectifying unit 110.

Compared results of the plurality of respective comparators 131*a*-1 through 131*a*-*n* of the comparing unit 131 may be transferred to the driving unit 132.

The driving unit 132 may supply switching driving signals SQ1 through SQn respectively driving switching on and switching off of the corresponding switch based on the comparison result of each of the plurality of comparators 131*a*-1 through 131*a*-*n*.

More specifically, the number of the plurality of comparators 131*a*-1 through 131*a*-*n* of the comparator unit 131 may correspond to the number of the plurality of switches Q1 through Qn.

Therefore, the comparison result of each of the plurality of comparators 131*a*-1 through 131*a*-*n* may be a basis of a signal for driving a plurality of switches Q11 through Q1N or Q21 through Q2N of a first switch group 121 or a second switch group 122.

The switching driving signals SQ1 through SQn of the driving unit 132 may be pulse width modulation (PWM) signals and each switching signal may repeatedly switch on and switch off the corresponding switch during the driving of the corresponding LED. A period in which the corresponding LED is driven may be determined depending on the comparison result of each of the plurality of comparators 131*a*-1 through 131*a*-*n*. The switching driving signals SQ1 through SQn of the driving unit 132 may PWM drive the plurality of switches Q1 through Qn.

The current limiting unit 140 may be connected to respective ends the plurality of switches Q1 through Qn to limit the current flowing in the corresponding LED by the PWM driving of each of the plurality of switches Q1 through Qn.

The adjusting unit 150 may adjust a current limit amount of the current limiting unit 140 according to a voltage level of the rectified power rec.

Figure 3:
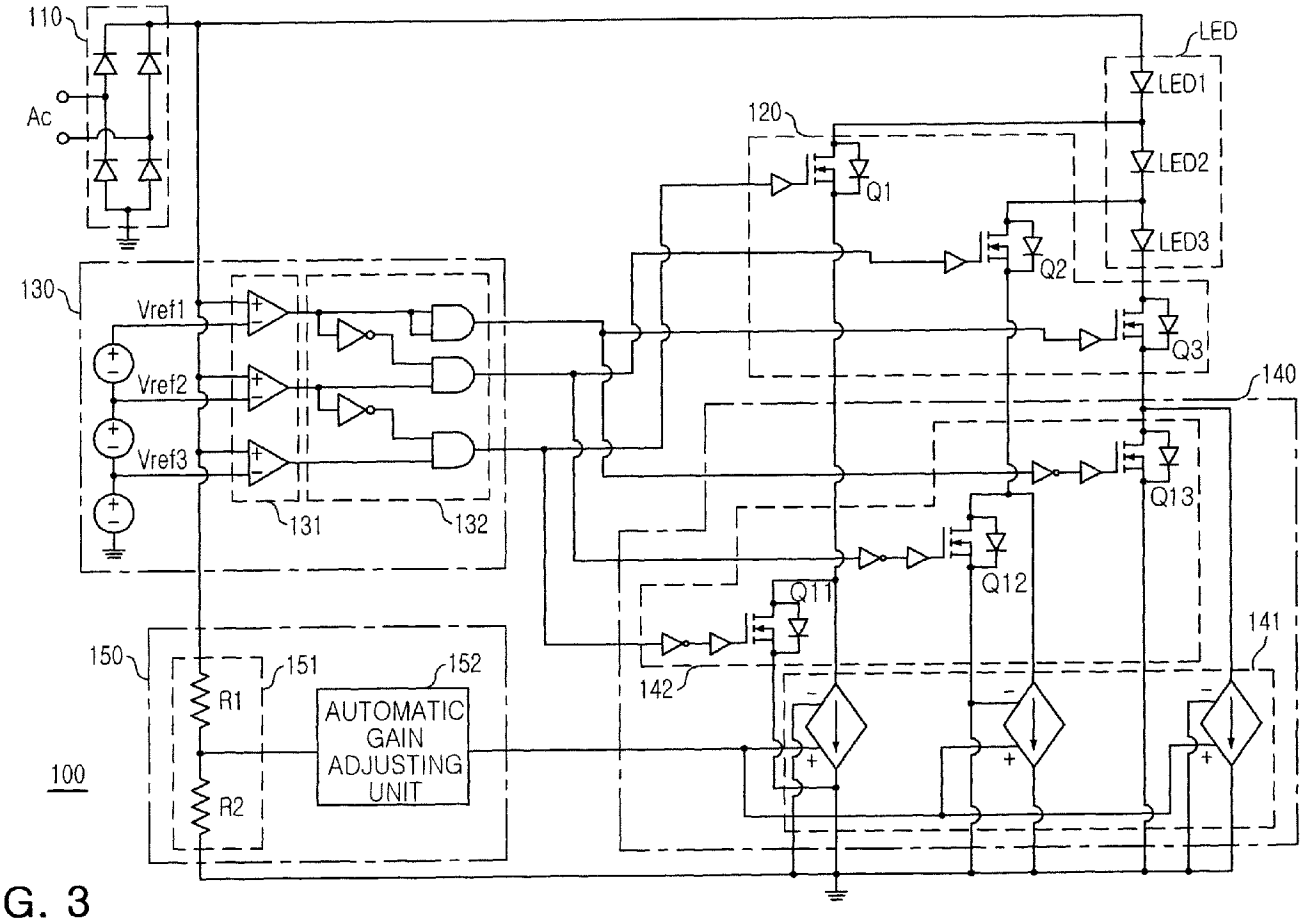
FIG. 3 is a circuit diagram schematically showing an example of the LED driving apparatus according to the embodiment of the present invention.

FIG. 3 is a circuit diagram schematically showing an example of the LED driving apparatus according to the embodiment of the present invention.

Referring to FIGS. 1 and 3, for example, in the case in which the LED driving apparatus 100 according to the embodiment of the present invention drives the first through third LEDs LED1, LED2, and LED3, the switching unit 120 may include the first through third switch Q1, Q2, and Q3, such that the first LED LED1, the first and second LEDs LED1 and LED2, or the first through third LEDs LED1, LED2, and LED3 may be driven. To this end, the driving control unit 130 compares the voltage level of the rectified power rec with each of the preset plurality reference voltage Vref1, Vref2, and Vref3, and the driving unit 132 may provide the switching driving signals driving the first through third switches Q1, Q2, and Q3 through logical operations using an AND element and an inverted AND element according to the comparison results of the respective comparators of the comparing unit 131.

The current limiting unit 140 may include a current control unit 141 and a current source unit 142. In this case, the current control unit 141 inverts the switching driving signals to perform switching on and switching off operations complementarily in conjunction with the switching on and switching off operations of the first through third switches Q1, Q2, and Q3, such that the current control unit 141 may be switched on when the corresponding switch is switched off to connect the current path to a ground and may control the current.

The current source unit 142 may include current sources respectively connected to the ends of the first through third switches Q1, Q2, and Q3, and the respective current sources may limit the current flowing in the respective first through third LEDs LED1, LED2, and LED3 according to the control of the adjusting unit 150.

Here, although the embodiment illustrates the case in which the current control unit 141 and the current source unit 142 include logic elements, switches, and current sources corresponding to the first through third switches Q1, Q2, and Q3, the number of the logical elements, the switches, and the current sources may also increase in the case in which the number of the switches increases.

The adjusting unit 150 may include a voltage dividing unit 151 and an automatic gain adjusting unit 152.

The voltage dividing unit 151 may divide the voltage level of the rectified power rec into voltage levels that may be processed, according to a preset resistance ratio and thus, may include a plurality of resistors R1 and R2 for the division.

The automatic gain adjusting unit 152 adjusts a current amount of the current limiting unit 140 according to the divided voltage level of the voltage dividing unit to enable a current waveform of the power input to the LED unit to follow a voltage waveform of the rectified power rec.

Figure 4:
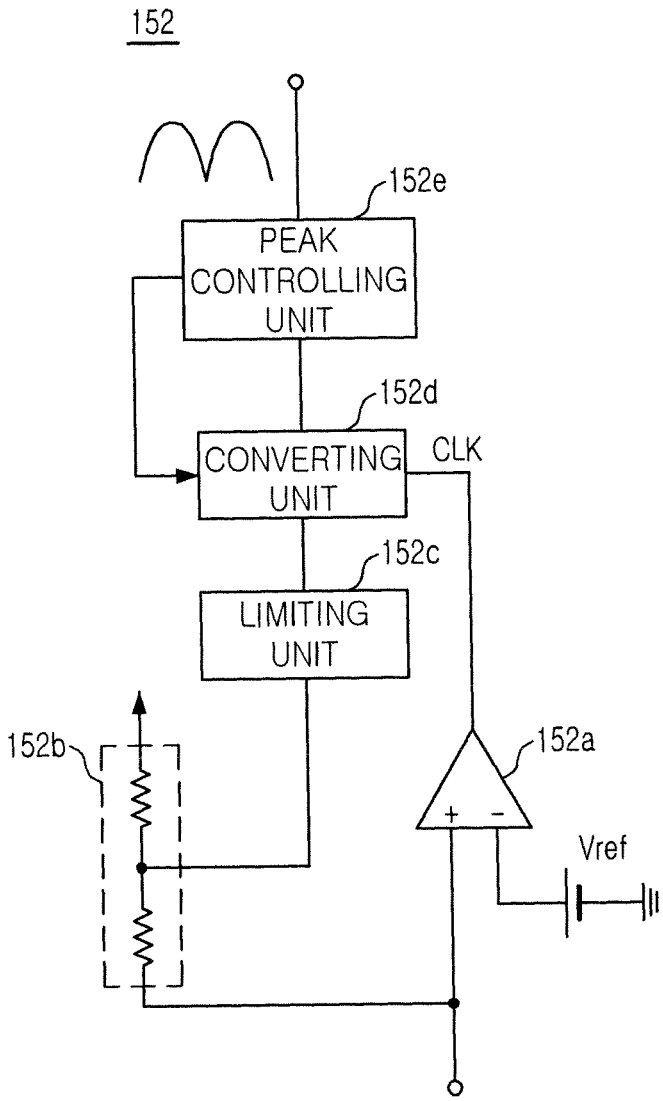
FIG. 4 is a configuration view schematically showing an adjusting unit used in the LED driving apparatus according to the embodiment of the present invention.

FIG. 4 is a configuration view schematically showing an adjusting unit used in the LED driving apparatus according to the embodiment of the present invention.

Referring to FIG. 4, the automatic gain adjusting unit 152 may include a comparator 152*a*, a dividing resistor group 152*b*, a limiting unit 152*c*, a converting unit 152*d*, and a peak controlling unit 152*e*.

The comparator 152*a* may compare the divided voltage level of the voltage dividing unit 151 with a level of a preset operational reference voltage Verf to provide a clock signal CLK according to the comparison result, the dividing resistor group 152*b* may divide the divided voltage level of the voltage dividing unit 151 according to the preset resistance ratio, and the limiting unit 152*c* limits the divided voltage level divided by the dividing resistor group 152*b* to a preset level.

The converting unit 152*d* may convert a peak value of the limited voltage level from the limiting unit 152*c* into a digital signal according to the clock signal CLK from the comparator 152*a*, and the peak controlling unit 152*e* may control the peak value of the voltage level from the converting unit 152*d* to maintain a constant peak voltage regardless of the divided voltage level of the voltage dividing unit 151.

Figure 5A:
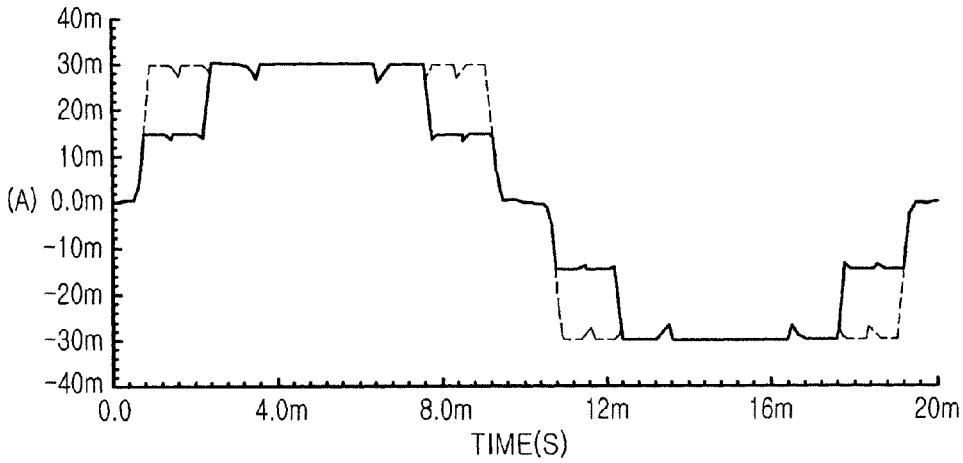
FIGS. 5A and 5B are graphs showing electrical characteristics of the LED driving apparatus according to the embodiment of the present invention.
Figure 5B:
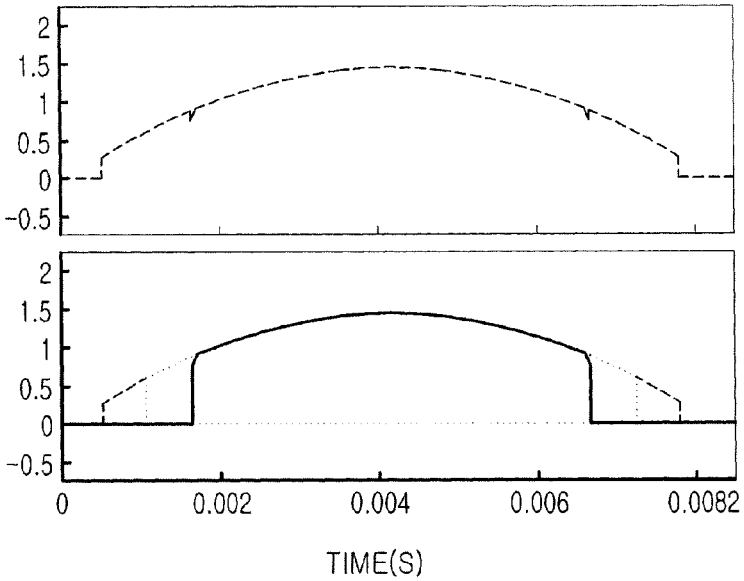

FIGS. 5A and 5B are graphs showing electrical characteristics of the LED driving apparatus according to the embodiment of the present invention.

Referring to FIG. 5A, in the LED driving apparatus, when the current is controlled in an one-step scheme, total harmonic distortion characteristics (THD) of 31.7% and a power factor of 0.953 are exhibited, while when the current is controlled in a two-step scheme, THD characteristics may be decreased to 15.6% and the power factor may be increased to 0.994. That is, since the voltage waveform of the rectified power has a sine wave form, in the case in which the current input to the LED approximately follows the voltage waveform of the rectified power, the THD and the power factor characteristics may be improved.

FIG. 5B shows a current waveform (an upper side graph) of the current input to the LED of the LED driving apparatus according to the embodiment of the present invention and a current waveform (a lower side graph) according to switch driving in the case of using three switches as shown in FIG. 4.

As shown in FIG. 5B, since the current waveform of the current input to the LED follows the sine wave except for dead time due to the switch, the THD and power factor characteristics may be improved in the LED driving apparatus according to the embodiment of the present invention.

As set forth above, according to the embodiment of the present invention, the current waveform of the current input to the LED follows the sine wave, whereby the power factor and THD characteristics can be improved.

While the present invention has been shown and described in connection with the embodiments, it will be apparent to those skilled in the art that modifications and variations can be made without departing from the spirit and scope of the invention as defined by the appended claims.

What is claimed is:

1. A light emitting diode (LED) driving apparatus, comprising:

a switching unit switching an LED unit having a plurality of LEDs receiving rectified power and emitting light;

a driving control unit controlling the switching of the switching unit according to a voltage level of the rectified power;

a current limiting unit limiting current flowing in the LED unit; and an adjusting unit adjusting current limitation of the current limiting unit according to the voltage level of the rectified power.

2. The LED driving apparatus of claim 1, wherein the adjusting unit adjusts the current of the current limiting unit according to a voltage waveform of the rectified power.

3. The LED driving apparatus of claim 1, wherein the adjusting unit includes:

a voltage dividing unit dividing the voltage level of the rectified power; and an automatic gain adjusting unit adjusting a current amount of the current limiting unit according to the divided voltage level of the voltage dividing unit.

4. The LED driving apparatus of claim 3, wherein the automatic gain adjusting unit includes:

a comparator comparing the divided voltage level of the voltage dividing unit with a level of a preset operational reference voltage;

a dividing resistor group dividing the divided voltage level of the voltage dividing unit according to a preset resistance ratio;

a limiting unit limiting the voltage level divided by the dividing resistor group to a preset level;

a converting unit converting a peak value of the limited voltage level from the limiting unit into a digital signal; and a peak controlling unit controlling the peak value of the voltage level from the converting unit to maintain a constant peak voltage regardless of the divided voltage level of the voltage dividing unit.

5. The LED driving apparatus of claim 1, wherein the switching unit includes a plurality of switches, respectively connected between connection points between the plurality of respective LEDs of the LED unit and the current limiting unit.

6. The LED driving apparatus of claim 1, wherein the driving control unit includes:

a comparing unit comparing the rectified power with a preset reference voltage; and a driving unit providing a switching driving signal controlling switching driving of the LED unit according to a comparison result of the comparing unit.

7. The LED driving apparatus of claim 6, wherein the comparing unit includes a plurality of comparators having a number corresponding to that of the LEDs of the LED unit.

8. The LED driving apparatus of claim 1, wherein the current limiting unit includes:

a current control unit having a plurality of switches controlling current flowing in the switching unit according to a driving control of the driving control unit; and a current source unit having a plurality of current sources adjusting a current amount according to a current adjustment of the adjusting unit.

9. The LED driving apparatus of claim 1, further comprising a rectifying unit rectifying alternating current (AC) power to supply the rectified power to at least one pair of the LEDs.

10. A light emitting diode (LED) driving apparatus, comprising:

a rectifying unit rectifying and supplying alternating current power;

a switching unit switching an LED unit having a plurality of LEDs receiving rectified power and emitting light;

a driving control unit controlling the switching of the switching unit according to a voltage level of the rectified power;

a current limiting unit limiting current flowing in the LED unit; and an adjusting unit adjusting current limitation of the current limiting unit according to a voltage waveform of the rectified power.

11. The LED driving apparatus of claim 10, wherein the adjusting unit includes:

a voltage dividing unit dividing the voltage level of the rectified power; and an automatic gain adjusting unit adjusting a current amount of the current limiting unit according to the divided voltage level of the voltage dividing unit.

12. The LED driving apparatus of claim 11, wherein the automatic gain adjusting unit includes:

a comparator comparing the divided voltage level of the voltage dividing unit with a level of a preset operational reference voltage;

a dividing resistor group dividing the divided voltage level of the voltage dividing unit according to a preset resistance ratio;

a limiting unit limiting the voltage level divided by the dividing resistor group to a preset level;

a converting unit converting a peak value of the limited voltage level from the limiting unit into a digital signal; and a peak controlling unit controlling the peak value of the voltage level from the converting unit to maintain a constant peak voltage regardless of the divided voltage level of the voltage dividing unit.

13. The LED driving apparatus of claim 10, wherein the switching unit includes a plurality of switches, respectively connected between connection points between the plurality of respective LEDs of the LED unit and the current limiting unit.

14. The LED driving apparatus of claim 10, wherein the driving control unit includes:

a comparing unit comparing the rectified power with a preset reference voltage; and a driving unit providing a switching driving signal controlling switching driving of the LED unit according to a comparison result of the comparing unit.

15. The LED driving apparatus of claim 14, wherein the comparing unit includes a plurality of comparators having a number corresponding to that of the LEDs of the LED unit.

16. The LED driving apparatus of claim 10, wherein the current limiting unit includes:

a current control unit having a plurality of switches controlling current flowing in the switching unit according to a driving control of the driving control unit; and a current source unit having a plurality of current sources adjusting a current amount according to a current adjustment of the adjusting unit.

* * * * *